US005158624A

United States Patent [19]

Okiyama et al.

[11] Patent Number: 5,158,624

[45] Date of Patent: Oct. 27, 1992

[54] SOFT-MAGNETIC NICKEL-IRON-CHROMIUM ALLOY

[75] Inventors: Takuji Okiyama; Takuji Hara; Keiji Osaki; Yutaka Kawai, all of Shinnanyo, Japan

[73] Assignee: Nisshin Steel Company Ltd., Tokyo, Japan

[21] Appl. No.: 576,683

[22] Filed: Aug. 31, 1990

[30] Foreign Application Priority Data

Sep. 4, 1989 [JP] Japan ..... 1-227445

[51] Int. Cl.[5] ..... C22C 38/08; C22C 38/18

[52] U.S. Cl. ..... 148/310; 148/315; 148/501; 148/506; 420/43; 420/97; 420/104; 420/112

[58] Field of Search ..... 420/43, 45, 64, 97, 420/104, 112; 148/310, 315, 501, 506; 428/685

[56] References Cited

U.S. PATENT DOCUMENTS

| | | | |
|---|---|---|---|
| 1,811,032 | 9/1931 | Smith et al. | 148/310 |
| 3,316,345 | 4/1967 | Toms et al. | 148/315 |
| 4,003,768 | 1/1977 | Anderson et al. | 148/310 |

FOREIGN PATENT DOCUMENTS

| | | |
|---|---|---|
| 59-151722 | 8/1984 | Japan . |
| 0140509 | 4/1920 | United Kingdom . |

*Primary Examiner*—R. Dean
*Assistant Examiner*—Sikyin Ip
*Attorney, Agent, or Firm*—Webb, Burden, Ziesenheim & Webb

[57] ABSTRACT

An alloy essentially consisting of 35–40% Ni, 5–14% Cr and balance Fe and unavoidable impurities has excellent alternating current magnetic characteristics and good direct current magnetic characteristics.

6 Claims, 4 Drawing Sheets

SOFT-MAGNETIC NICKEL-IRON-CHROMIUM ALLOY

FIELD OF THE INVENTION

This invention relates to a soft-magnetic nickel-iron-chronium (Ni-Fe-Cr) alloy suitable for magnetic shielding wherein high magnetic permeability is required.

BACKGROUND OF THE INVENTION

High magnetic permeability Ni-Fe alloys are widely used as magnetic shielding materials such as materials for casings of magnetic heads, magnetic shielding plates for cassette tape digitizers, etc. For such magnetic shielding materials, high magnetic permeability in the low frequency bands is required as an alternating current magnetic characteristic. Often inductance specific magnetic permeability $\mu_L$ of not less than 9000 at 0.3 kHz or of not less than 4500 at 1 kHz is required. Also, with respect to direct current magnetism, often high characteristics such as coercive force Hc of not more than 0.10 Oe and saturated magnetic flux density Bs of not less than 3000 G are required.

Therefore, 80% Ni Permalloy (JIS-PC(corresponding to ASTM A753)), which contains Mo, Cr, Cu, etc. and has the highest magnetic permeability among the Ni-Fe magnetic alloys, is widely used as magnetic shielding materials. However, this alloy has a disadvantage that it is expensive, because the alloy contains no less than 80% of expensive Ni as well as the more expensive Mo. Therefore, there is a demand for an inexpensive magnetic alloy which has magnetic characteristics comparable with those of JIS-PC alloy.

The principal object of the present invention is to provide a novel soft-magnetic alloy which is provided with alternating current magnetic characteristics of the same level as those of JIS-PC alloy or better and yet is inexpensive.

We studied magnetic properties of a number of Fe-Ni . magnetic alloys and found that alloys comprising 35–40% Ni, 5–14% Cr and balance Fe have alternating current magnetic characteristics, such as magnetic permeability, of the same level as those of JIS PC alloys or JIS PB alloys (45% Ni Permalloy) or better in spite that the Ni content is far less than the latter.

SUMMARY OF THE INVENTION

This invention provides a soft-magnetic nickel-iron-chromium (Ni-Fe-Cr) alloy having excellent alternating current magnetic characteristics, which essentially consists of:

35–40% Ni

5–14% Cr and balance Fe and unavoidable impurities, and satisfies the relations:

$3(Ni\%)-5(Cr\%)\leqq 80$ and $(Ni\%)-(Cr\%)\leqq 25$

The alloy should preferably satisfy the following conditions. The contents of the impurity elements S, 0 and B should be $S\leqq 0.003\%$ $O\leqq 0.005\%$ $B\leqq 0.005\%$ and that $S+O+B\leqq 0.008\%$ Preferably, the B content should be not more than 0.002%.

In the alloy of the present invention Si and Al which are used for deoxidation and Mn which is used for deoxidation and desulfurization can be contained up to 1% in total.

In the alloy of the present invention, Cr is effective for reducing the coercive force and increases the magnetic permeability under alternating current. Such effect does not well appear with less than 5% Cr. The magnetic permeability is saturated at around 13–14% Cr.

Ni enhances the alternating current magnetic characteristics caused by addition of Cr when contained in an amount of around 35% or more. With less content of Ni, inductance specific magnetic permeability $\mu_L$ decreases. On the other hand, addition of a larger amount of Ni not only raises the price of the alloy but also decreases inductance specific magnetic permeability $\mu_L$. The upper limit of the Ni content will be around 40%.

With respect to the contents of Ni and Cr, the following condition must be satisfied $47\leqq 3(Ni\%)=5(Cr\%)\leqq 80$ in order that the alloy is provided with inductance specific magnetic permeability, which is one of the alternating current magnetic characteristics, of the same level as that of the JIS-PC alloy or better. In addition, the following relation also must be satisfied $(Ni\%)-(Cr\%)\geqq 25$ in order that direct current saturated magnetic flux density Bs, which is a significant factor for magnetic shielding materials, is 3000 G or more, since the direct current saturated magnetic flux density decreases with increase of the Cr content.

The contents of impurity elements such as S, O, B, P, N, etc. should be as low as possible from the viewpoint of improvement of magnetic characteristics. Especially, S, O and B impair the coarsening of crystal grains in magnetic annealing and decreases inductance specific magnetic permeability $\mu_L$. Therefore, it is desirable that the alloy composition satisfies the following conditions $S\leqq 0.003\%$, $O\leqq 0.005\%$, $B\leqq 0.005$ and $S+O+B\leqq 0.008\%$ in order to increase the $\mu_L$ value at low frequencies, especially of 0.3 kHz.

The alloy of the present invention is usually annealed in a hydrogen atmosphere. When the B content is not more than 0.002%, the alloy can be annealed in vacuo instead of an hydrogen atmosphere with same effect.

In the present invention, the preferred content range of Ni is 36–39% and the more preferred content range is 36–38 %. The preferred content range of the Cr content is 7–12% and the more preferred content range is 8–10%.

The alloy of the present invention has excellent alternating current magnetic characteristics and satisfies direct current magnetic characteristics required for magnetic shielding materials, and yet is inexpensive. This alloy is suitable as a magnetic shielding material for various magnetic shielding members including magnetic head casings.

BRIEF DESCRIPTION OF THE ATTACHED DRAWINGS

SPECIFIC DESCRIPTION OF THE INVENTION

Ingots of alloys the compositions of which are indicated in Table 1 were respectively prepared by vacuum melting, and made into 0.4 mm thick sheets by means of ordinary hot rolling and cold rolling. Annular pieces having an external diameter of 10 mm and an internal diameter of 6 mm were cut out of these sheets. They were annealed at 1100° C. for 1 hour in a hydrogen atmosphere and then cooled. Coercive force Hc, saturated magnetic flux density Bs and inductance specific magnetic permeability $\mu_L$ of the thus obtained specimens were measured in accordance with the test methods stipulated in JIS C2531. The results are shown in Table 2.

Figure 1:
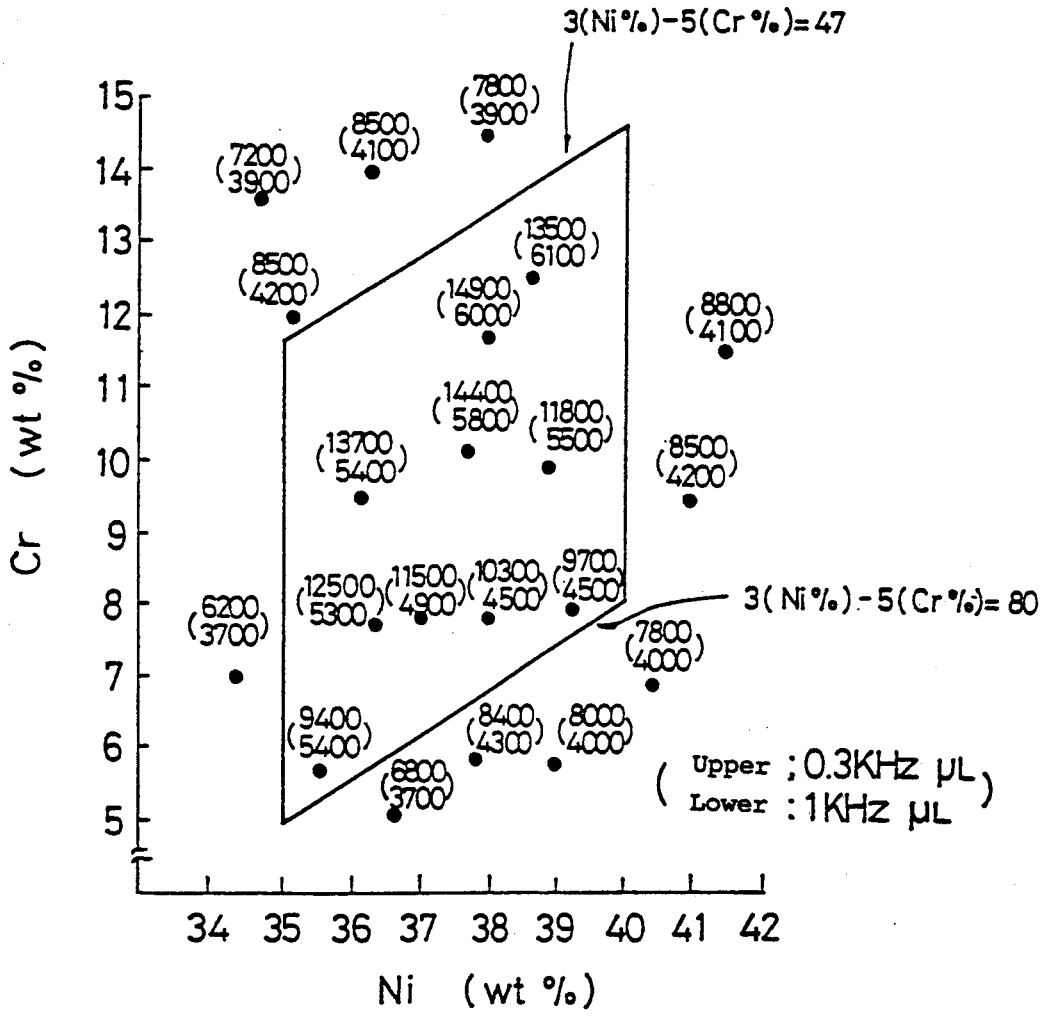
FIG. 1 is a diagram which shows the relation between the contents of Ni and Cr and the inductance specific magnetic permeability $\mu_L$.

FIG. 1 shows inductance specific magnetic permeability ($\mu_L$) values at 0.3 kHz and 1 kHz out of all the measurement values of all the specimens. As is apparent from FIG. 1, when the alloy contains 35–40% Ni, inductance specific magnetic permeability of the alloy increases with increase of the Cr content and has alternating current magnetic characteristics of the same level as those of JIS-PC alloy or better within the domain surround by solid lines.

Figure 2:
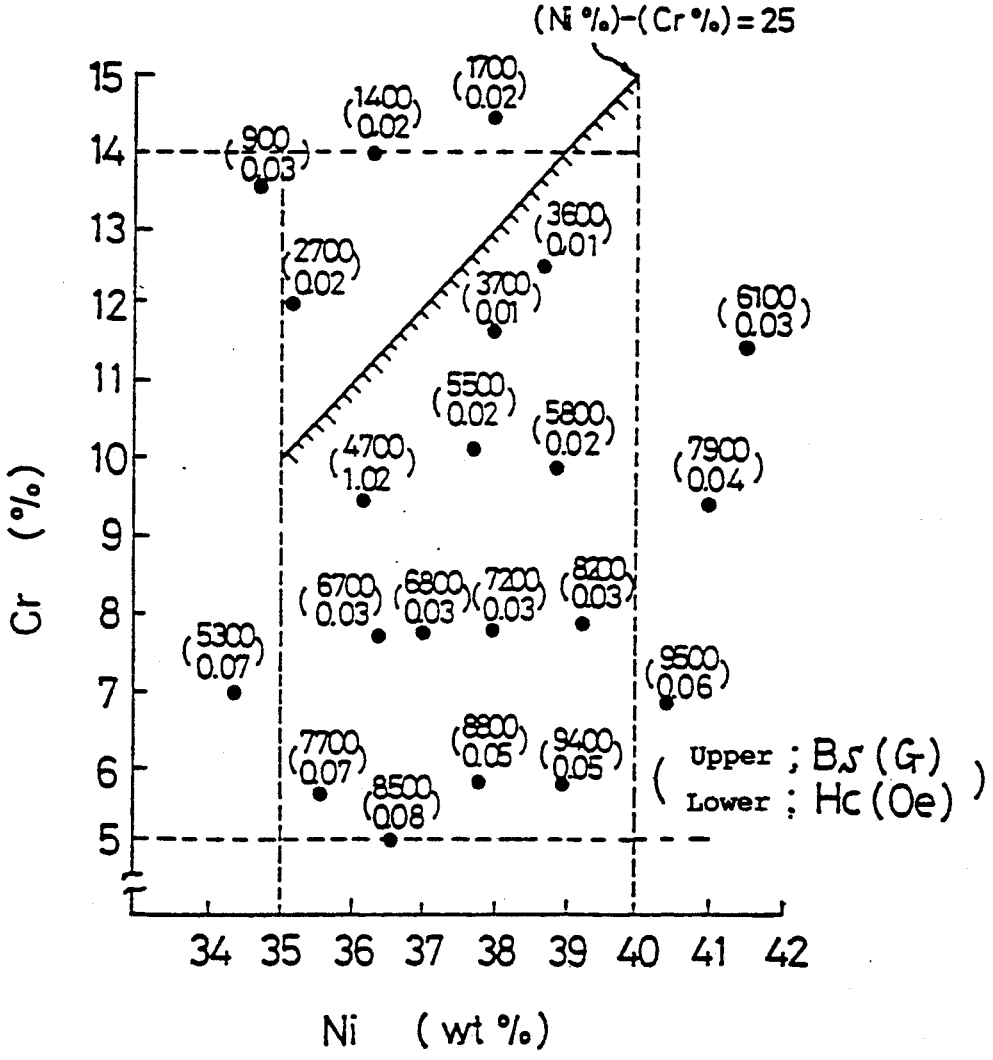
FIG. 2 is a diagram which shows the relation between the contents of Ni and Cr and the coercive force Hc and the saturated magnetic flux density Bs.

FIG. 2 shows values of saturated magnetic flux density (Bs) values and coercive force (Hc) values out of direct current magnetic characteristics. As is apparent from FIG. 2, the alloy satisfies saturated magnetic flux density (Bs) of ≧3000 G, which is required for magnetic shielding materials in the domain below the solid line. All the samples have a coercive force Hc of ≦0.10 and this increases with increase of the Cr content.

Figure 4:
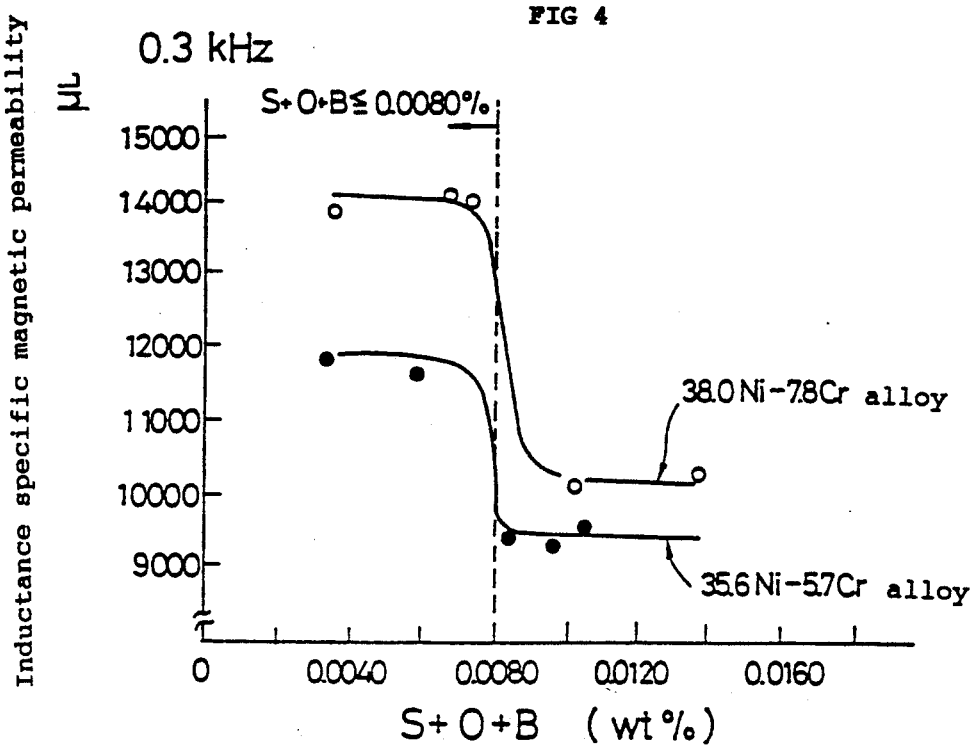
FIG. 4 is a diagram which shows the influence of the content of S+O+B to inductance specific magnetic permeability $\mu_L$ at 0.3 kHz.
Figure 5:
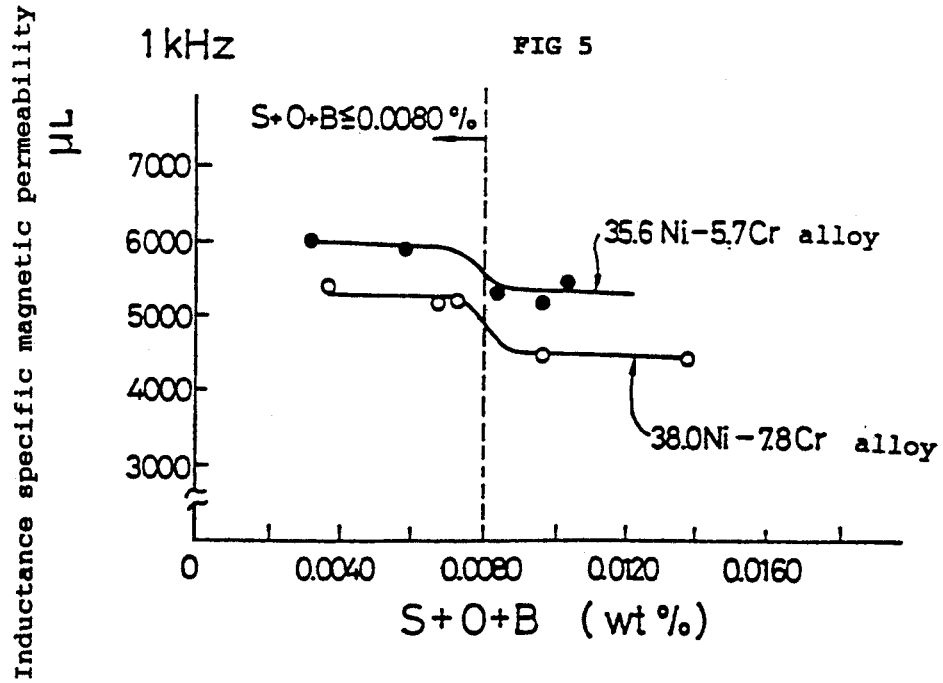
FIG. 5 is a diagram which shows the influence of the content of S+O +B to inductance specific magnetic permeability $\mu_L$ at 1 kHz.

Also, as shown in Table 2, the Bs value does not vary with the same contents of Ni and Cr. However, FIGS. 4 and 5 show that the $\mu_L$ value improves if the contents of S, O and B are reduced to S+O+B≦0.008%.

Figure 3:
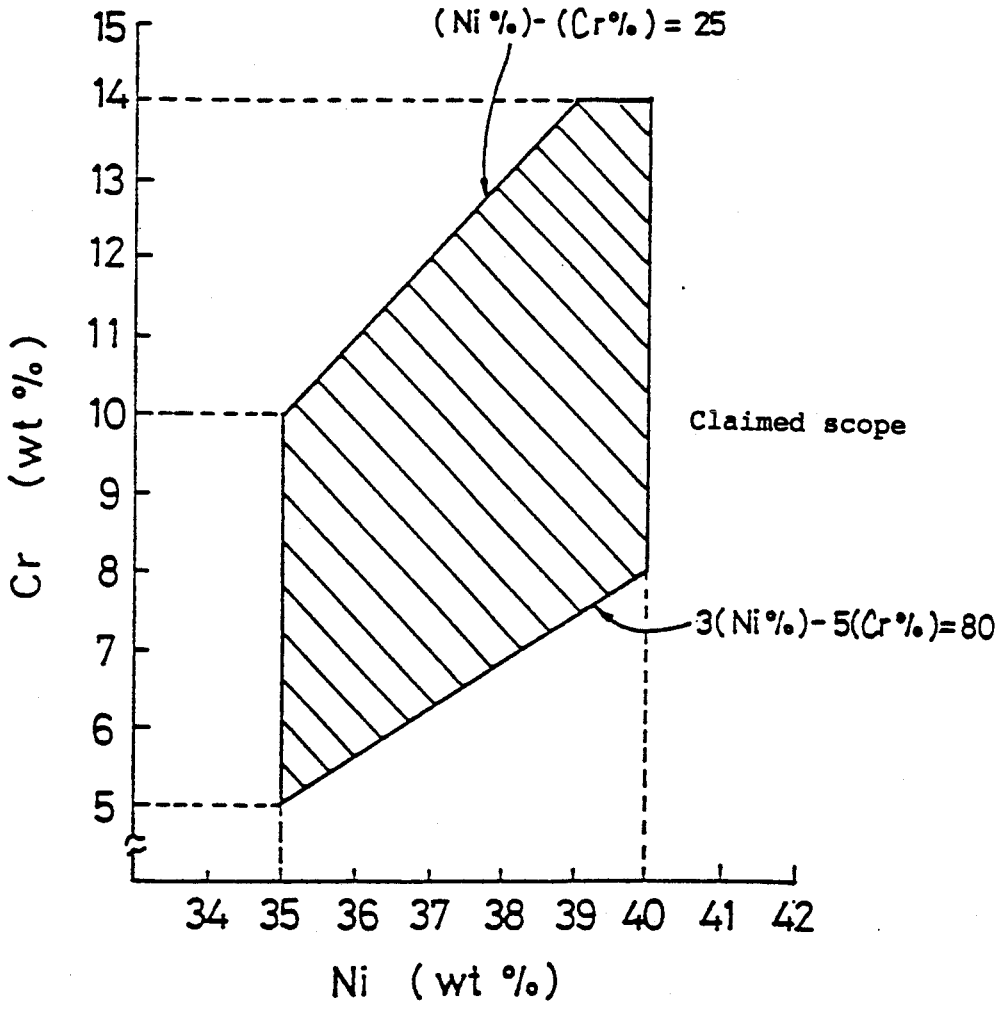
FIG. 3 is a diagram which shows the claimed composition range of the present invention.

As has been described above, a magnetic alloy, which is provided with direct current magnetic characteristics required for magnetic shielding materials and has excellent alternating current magnetic characteristics of the same level as those of JIS-PC alloy, can be obtained by defining the alloy composition as indicated by FIG. 3. Further, an alloy having excellent alternating current magnetic characteristics can be obtained by reducing the content of S+O+B≦0.008% as shown in FIGS. 4 and 5.

TABLE 1

| No. | Ni | Cr | C | Si | Mn | Al | P | N | S | O | B | (wt %) S + O + B |
|---|---|---|---|---|---|---|---|---|---|---|---|---|
| 1 | 34.4 | 6.9 | 0.01 | 0.21 | 0.43 | 0.011 | 0.014 | 0.0025 | 0.0022 | 0.0038 | 0.0025 | 0.0085 |
| 2 | 34.7 | 13.1 | 0.02 | 0.29 | 0.50 | 0.007 | 0.011 | 0.0031 | 0.0022 | 0.0053 | 0.0005 | 0.0080 |
| 3 | 35.2 | 11.8 | 0.02 | 0.18 | 0.52 | 0.010 | 0.013 | 0.0033 | 0.0032 | 0.0018 | 0.0043 | 0.0093 |
| 4 *1 | 35.6 | 5.7 | 0.02 | 0.20 | 0.62 | 0.019 | 0.010 | 0.0033 | 0.0033 | 0.0028 | 0.0026 | 0.0087 |
| 5 *1 | 36.4 | 7.7 | 0.01 | 0.20 | 0.57 | 0.015 | 0.008 | 0.0021 | 0.0025 | 0.0032 | 0.0038 | 0.0095 |
| 6 *1 | 36.2 | 9.5 | 0.01 | 0.28 | 0.55 | 0.008 | 0.012 | 0.0022 | 0.0028 | 0.0051 | 0.0005 | 0.0084 |
| 7 | 36.4 | 14.0 | 0.02 | 0.19 | 0.42 | 0.023 | 0.011 | 0.0027 | 0.0019 | 0.0021 | 0.0010 | 0.0050 |
| 8 | 36.6 | 5.1 | 0.01 | 0.11 | 0.45 | 0.018 | 0.010 | 0.0018 | 0.0015 | 0.0038 | 0.0030 | 0.0083 |
| 9 *1 | 37.0 | 7.8 | 0.02 | 0.15 | 0.61 | 0.012 | 0.007 | 0.0021 | 0.0018 | 0.0041 | 0.0025 | 0.0084 |
| 10 | 37.8 | 5.9 | 0.02 | 0.18 | 0.57 | 0.007 | 0.007 | 0.0019 | 0.0043 | 0.0028 | 0.0044 | 0.0115 |
| 11 *1 | 38.0 | 7.8 | 0.01 | 0.18 | 0.48 | 0.005 | 0.011 | 0.0031 | 0.0020 | 0.0028 | 0.0059 | 0.0107 |
| 12 *1 | 37.7 | 10.1 | 0.01 | 0.25 | 0.39 | 0.007 | 0.015 | 0.0018 | 0.0028 | 0.0030 | 0.0025 | 0.0083 |
| 13 *1 | 38.0 | 11.7 | 0.01 | 0.22 | 0.44 | 0.021 | 0.010 | 0.0020 | 0.0040 | 0.0021 | 0.0010 | 0.0071 |
| 14 | 38.0 | 14.5 | 0.01 | 0.15 | 0.46 | 0.010 | 0.006 | 0.0021 | 0.0022 | 0.0025 | 0.0008 | 0.0055 |
| 15 | 39.0 | 5.8 | 0.01 | 0.23 | 0.45 | 0.008 | 0.005 | 0.0033 | 0.0015 | 0.0033 | 0.0043 | 0.0091 |
| 16 *1 | 39.3 | 7.9 | 0.02 | 0.19 | 0.51 | 0.011 | 0.006 | 0.0042 | 0.0038 | 0.0018 | 0.0040 | 0.0096 |
| 17 *1 | 38.9 | 9.9 | 0.01 | 0.18 | 0.51 | 0.014 | 0.014 | 0.0029 | 0.0022 | 0.0032 | 0.0044 | 0.0098 |
| 18 *1 | 38.7 | 12.5 | 0.02 | 0.17 | 0.55 | 0.009 | 0.011 | 0.0017 | 0.0017 | 0.0018 | 0.0060 | 0.0095 |
| 19 | 40.4 | 6.9 | 0.02 | 0.25 | 0.58 | 0.010 | 0.008 | 0.0019 | 0.0034 | 0.0033 | 0.0005 | 0.0072 |
| 20 | 40.9 | 9.3 | 0.02 | 0.25 | 0.48 | 0.024 | 0.011 | 0.0026 | 0.0025 | 0.0022 | 0.0039 | 0.0088 |
| 21 | 41.5 | 11.5 | 0.01 | 0.22 | 0.44 | 0.008 | 0.012 | 0.0048 | 0.0018 | 0.0015 | 0.0070 | 0.0103 |
| 22 *2 | 35.5 | 5.8 | 0.01 | 0.18 | 0.57 | 0.012 | 0.009 | 0.0018 | 0.0025 | 0.0029 | 0.0005 | 0.0059 |
| 23 *2 | 35.7 | 5.7 | 0.02 | 0.19 | 0.60 | 0.008 | 0.008 | 0.0024 | 0.0015 | 0.0011 | 0.0008 | 0.0034 |
| 24 | 35.4 | 5.8 | 0.01 | 0.19 | 0.55 | 0.007 | 0.011 | 0.0023 | 0.0028 | 0.0044 | 0.0032 | 0.0104 |
| 25 | 35.5 | 5.7 | 0.01 | 0.21 | 0.60 | 0.022 | 0.008 | 0.0035 | 0.0037 | 0.0019 | 0.0005 | 0.0061 |
| 26 | 35.6 | 5.7 | 0.02 | 0.19 | 0.59 | 0.021 | 0.006 | 0.0017 | 0.0015 | 0.0021 | 0.0059 | 0.0095 |
| 27 *2 | 37.9 | 7.8 | 0.01 | 0.18 | 0.45 | 0.023 | 0.010 | 0.0021 | 0.0012 | 0.0013 | 0.0010 | 0.0035 |
| 28 *2 | 38.0 | 7.9 | 0.02 | 0.22 | 0.53 | 0.005 | 0.012 | 0.0022 | 0.0014 | 0.0025 | 0.0030 | 0.0069 |
| 29 *2 | 38.0 | 7.8 | 0.01 | 0.21 | 0.55 | 0.006 | 0.006 | 0.0031 | 0.0026 | 0.0038 | 0.0010 | 0.0074 |
| 30 | 37.8 | 7.9 | 0.01 | 0.19 | 0.55 | 0.005 | 0.011 | 0.0028 | 0.0038 | 0.0019 | 0.0045 | 0.0102 |
| 31 | 38.0 | 7.9 | 0.01 | 0.20 | 0.54 | 0.011 | 0.007 | 0.0017 | 0.0015 | 0.0059 | 0.0005 | 0.0079 |
| 32 | 37.9 | 7.8 | 0.01 | 0.20 | 0.63 | 0.024 | 0.009 | 0.0020 | 0.0041 | 0.0056 | 0.0040 | 0.0137 |
| PB | 46.2 | 0.1 | 0.01 | 0.21 | 0.45 | 0.008 | 0.012 | 0.0030 | 0.0024 | 0.0030 | 0.0011 | 0.0065 |
| PC | 79.0 | (Mo; 4.1) | 0.01 | 0.25 | 0.51 | 0.010 | 0.005 | 0.0010 | 0.0020 | 0.0025 | 0.0040 | 0.0085 |

*1 alloy of Claim 1
*2 alloy of Claim 2
PB, PC = JIS alloys

TABLE 2

| No. | Hc (Oe) | Bs (G) | μL 0.3 kHz | μL 1 kHz |
|---|---|---|---|---|
| 1 | 0.07 | 5300 | 6200 | 3700 |
| 2 | 0.03 | 900 | 7200 | 3900 |
| 3 | 0.02 | 2700 | 8500 | 4200 |
| 4 *1 | 0.07 | 7700 | 9400 | 5400 |
| 5 *1 | 0.03 | 6700 | 12500 | 5300 |
| 6 *1 | 0.02 | 4700 | 13700 | 5400 |

TABLE 2-continued

| No. | Hc (Oe) | Bs (G) | μL 0.3 kHz | μL 1 kHz |
|---|---|---|---|---|
| 7 | 0.02 | 1400 | 8500 | 4100 |
| 8 | 0.08 | 8500 | 6800 | 3900 |
| 9 *1 | 0.03 | 6800 | 11500 | 4900 |
| 10 | 0.05 | 8800 | 8500 | 4300 |
| 11 *1 | 0.03 | 7200 | 10300 | 4500 |
| 12 *1 | 0.02 | 5500 | 14400 | 5800 |
| 13 *1 | 0.01 | 3700 | 14900 | 6000 |
| 14 | 0.02 | 1700 | 7800 | 3900 |
| 15 | 0.04 | 9400 | 8000 | 4000 |
| 16 *1 | 0.03 | 8200 | 9700 | 4500 |
| 17 *1 | 0.02 | 5800 | 11800 | 5500 |
| 18 *1 | 0.01 | 3600 | 13500 | 6100 |
| 19 | 0.06 | 9500 | 7800 | 4000 |
| 20 | 0.04 | 7900 | 8500 | 4200 |
| 21 | 0.03 | 6100 | 8800 | 4100 |
| 22 *2 | 0.05 | 7600 | 11700 | 6100 |
| 23 *2 | 0.05 | 7700 | 11900 | 6000 |
| 24 | 0.07 | 7700 | 9600 | 5500 |
| 25 | 0.07 | 7600 | 9300 | 5500 |
| 26 | 0.07 | 7700 | 9400 | 5300 |
| 27 *2 | 0.01 | 7200 | 13800 | 5400 |
| 28 *2 | 0.01 | 7200 | 14200 | 5200 |
| 29 *2 | 0.02 | 7300 | 14100 | 5200 |
| 30 | 0.03 | 7200 | 10100 | 4600 |
| 31 | 0.03 | 7300 | 10300 | 4500 |
| PB | 0.15 | 15000 | 3800 | 2100 |
| PC | 0.02 | 8200 | 9300 | 4500 |

We claim:

1. A soft-magnetic nickel-iron chromium (Ni-Fe-Cr) alloy having excellent alternating current magnetic characteristics, which essentially consists of:

35–40% Ni

5–14% Cr and balance Fe and unavoidable impurities, and satisfies the relations $3(Ni\%)-5(Cr\%) \leqq 80$ and $(Ni\%)-(Cr\%) \geqq 25$, wherein the S content is not more than 0.003% the O content is not more than 0.005% the B content is not more than 0.005%, and the contents of S+O+B is not more than 0.008%.

2. A soft-magnetic nickel-iron-chromium alloy as claimed in claim 1, wherein the B content is not more than 0.002%.

3. A soft-magnetic nickel-iron chromium alloy as claimed in claim 1, wherein the Ni content is 36–39% and the Cr content is 7–12%.

4. A soft-magnetic nickel-iron-chromium alloy as claimed in claim 2, wherein the Ni content is 36–39% and the Cr content is 7–12%.

5. A soft-magnetic nickel-iron-chromium alloy as claimed in claim 1, wherein the Ni content is 36–38% and the Cr content is 8–10%.

6. A soft-magnetic nickel-iron-chromium alloy as claimed in claim 2, wherein the Ni content is 36–38% and the Cr content is 8–10%.

* * * * *

UNITED STATES PATENT AND TRADEMARK OFFICE

CERTIFICATE OF CORRECTION

PATENT NO. : 5,158,624

DATED : October 27, 1992

INVENTOR(S) : Takuji Okiyama, Takuji Hara, Keiji Osaki and Yutaka Kawai

It is certified that error appears in the above-identified patent and that said Letters Patent is hereby corrected as shown below:

Please delete present claim 1 and insert claim 1 as follows:

Column 6, lines 1-17,

--1. A soft-magnetic nickel-iron-chromium (Ni-Fe-Cr) alloy having excellent alternating current magnetic characteristics, exhibiting a magnetic flux density ($B_s$) of at least 3000, a coercive force ($H_c$) of no greater than 0.10, an inductance specific magnetic permeability ($\mu_L$) at 0.3 kHz of greater than 9,400 and greater than 4,500 at 1.0 kHz, which essentially consists of:

35 - 39% Ni
greater than 5 - 14% Cr
no more than 0.02% C
less than 0.20% Si, wherein
Si + Al + Mn $\leq$ 1.0 and balance Fe and unavoidable impurities, and satisfies the relations
3(Ni%) - 5(Cr%) $\leq$ 80 and (Ni%) - (Cr%) $\geq$ 25,

UNITED STATES PATENT AND TRADEMARK OFFICE

CERTIFICATE OF CORRECTION

PATENT NO. : 5,158,624 Page 2 of 2

DATED : October 27, 1992

INVENTOR(S) : Takuji Okiyama, Takuji Hara, Keiji Osaki and Yutaka Kawai

It is certified that error appears in the above-indentified patent and that said Letters Patent is hereby corrected as shown below:

wherein the S content is not more than 0.003%
the O content is not more than 0.005%
the B content is not more than 0.005% and the contents of S+O+B is not more than 0.008%.--

Signed and Sealed this

Twenty-eighth Day of December, 1993

Attest:

Bruce Lehman

BRUCE LEHMAN

Attesting Officer

Commissioner of Patents and Trademarks